United States Patent [19]

Berges et al.

[11] 4,114,361

[45] * Sep. 19, 1978

[54] TWISTING MACHINE PROCESS FOR STRANDING WIRES

[75] Inventors: Dietrich Berges, Marienheide; Bodo Damzog, Remscheid; Ulrich Saam, Gummersbach, all of Germany

[73] Assignee: Barmag Barmer Maschinenfabrik AG, Wuppertal, Germany

[ * ] Notice: The portion of the term of this patent subsequent to Jan. 11, 1994, has been disclaimed.

[21] Appl. No.: 757,882

[22] Filed: Jan. 10, 1977

Related U.S. Application Data

[62] Division of Ser. No. 542,198, Jan. 20, 1975, Pat. No. 4,002,015.

[51] Int. Cl.[2] ..... D01H 7/90; D07B 3/02

[52] U.S. Cl. ..... 57/156; 57/58.38

[58] Field of Search ..... 57/58.3–58.38, 57/156

[56] References Cited

U.S. PATENT DOCUMENTS

| | | | |
|---|---|---|---|
| 2,723,525 | 11/1955 | Blaisdell | 57/58.36 |
| 3,557,540 | 1/1971 | Martinez | 57/58.36 X |
| 3,613,348 | 10/1971 | Costa | 57/58.32 X |
| 3,830,050 | 8/1974 | Ueda | 57/58.34 |
| 4,002,015 | 1/1977 | Berges et al. | 57/58.38 |

FOREIGN PATENT DOCUMENTS

| | | | |
|---|---|---|---|
| 14,979 | 6/1968 | Japan | 57/58.34 |

*Primary Examiner*—Charles Gorenstein

*Attorney, Agent, or Firm*—Keil, Thompson & Shurtleff; Keil, Thompson & Shurtleff; Keil, Thompson & Shurtleff

[57] ABSTRACT

A high-speed twisting machine for stranding wires or the like wherein there are a plurality of rotor units or assemblies, one on each side of a cradled take-off spool, each rotor unit consisting essentially of a rotatably driven hollow bearing tube with inlet and outlet openings for the transported wires in combination with open-ended concave guide pots attached at their base to the opposing faces or ends of the bearing tubes on either side of a cradled take-off spool, the outer peripheral guide surface of each pot being symmetrical around the machine axis to define a curved surface corresponding closely to the path of the transported wires taken off during normal twisting operation. The wire openings or bores near the end of the bearing tube must be located outside the curved guide surface of the guide pot connected to the same tube end to provide easy access and visibility. A retaining ring is preferably mounted at the rim concentrically around the open end of each guide pot to control a so-called ballooning effect. The twisting machine is useful for a wide variety of twisting or stranding operations requiring rapid transport of a plurality of wires or the like.

2 Claims, 2 Drawing Figures

TWISTING MACHINE PROCESS FOR STRANDING WIRES

Figure 1:
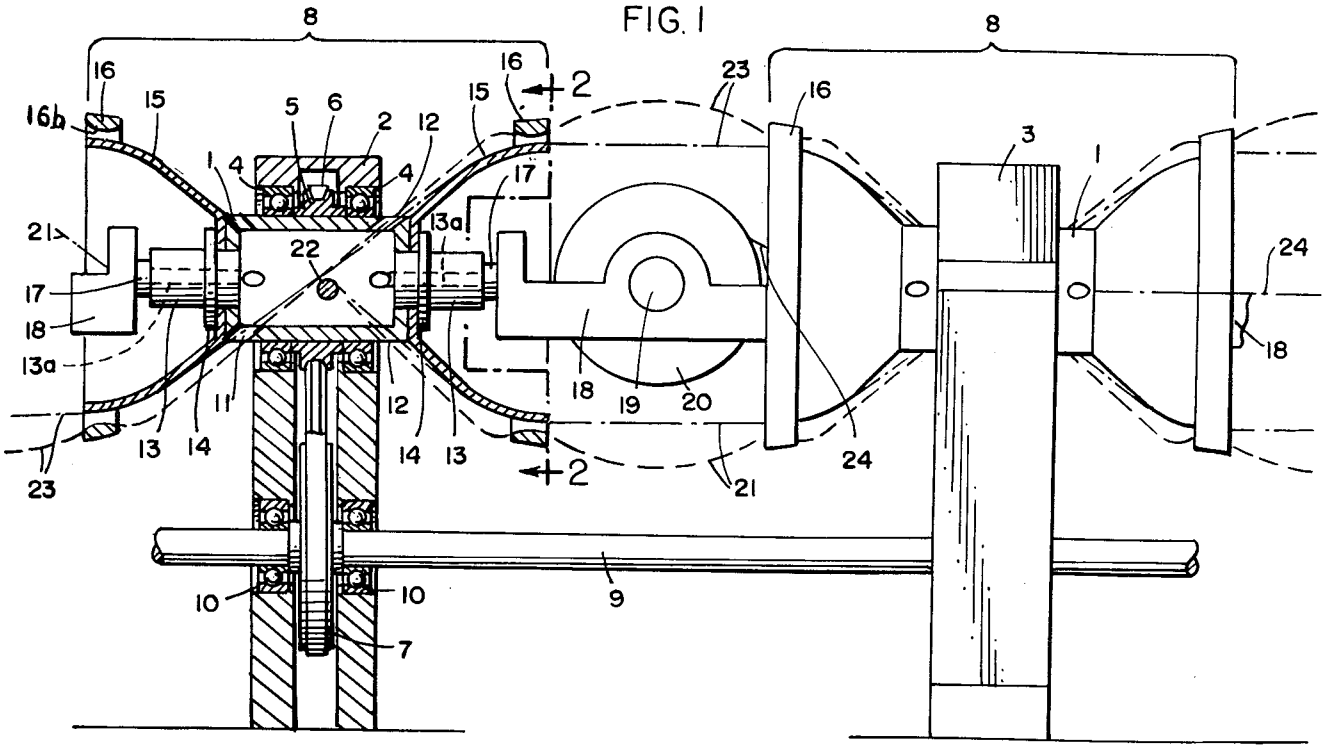

This application is a division of our application, Ser. No. 542,198, filed Jan. 20, 1975, now U.S. Pat. No. 4,002,015, issued Jan. 11, 1977.

A so-called high-speed twisting machine or wire stranding machine is already known from German Patent No. (DT-PS) 600,390 and includes take-off spools pivotally mounted in individual spool carriers for free oscillation on the machine axis together with discs which are used for mounting the spool carriers and for guiding the wires to be twisted, these discs being individually mounted independently of one another in the absence of connecting rods with means to drive all the discs at the same rotational speed. The wire-guide means used in this high-speed twisting machine are in the form of tubes which are fixed to the discs. The function of these tubes is to guide the wires outwardly from the machine axis around the preceding spool carrier with its associated take-off spool. The wires then travel freely without any guide between the outlet end of each tube and the next disc.

The disadvantage of a tube as a wire-guide means is that serious difficulties are involved in threading a stiff wire. The wire suddenly changes direction at the outlet end of the guide tube and the wire rubs along the walls of the tube so that considerable tension is requred to pull the wire through the tube. The degree of friction and, hence, the degree of tension in the wire is governed by the centrifugal force applied to the wire, this force increasing with greater rotational speed of the twisting machine.

In another known twisting or stranding machine disclosed in the German published application (DT-OS) 2,164,131, a short cylindrical frame fixedly connected to the disc is used as wire guide with the object of guiding each wire not only around the following spool carrier with its associated take-off spool, but also back to the center of the next disc. These guide frames are pot-like in shape and include openings for the wires around the rim of the pot. At the base of the pot, there are inlet openings for guiding the wires through the disc.

These pot-like guide frames have all the disadvantages of a guide tube because, strictly speaking, they merely represent a shortened tube. Still another disadvantage is the fact that the pot-shaped frames cause considerable difficulties in threading the wires, because the frames interfere both with the visibility of and the accessibility to the inlet openings for guiding the wires through the discs.

One object of the present invention is to obviate the disadvantages of conventional high-speed twisting or stranding machines, especially so as to enable the wires to be guided freely between the mounting or bearing members and around the spool carriers with only a minimal change in the direction of the wires due to guide means and with only limited contact pressure between the guide means and the transported wires.

This and other objects and advantages of the invention will become more apparent upon consideration of the following detailed specification.

The present invention is directed to a twisting machine of the type used for stranding wires or the like and including a plurality of rotatably mounted bearing members which are arranged in axial alignment on said machine and spaced at an interval one behind the other, a spool carrier for a take-off spool pivotally mounted for free oscillation and interposed between each of at least two successive bearing members, means to rotatably drive the bearing members at the same rotational speed and guide means to guide the wires in a transported path through each bearing member and outwardly around each individual spool carrier with its take-off spool.

It has now been found, in accordance with the invention, that such a twisting machine can be substantially improved by providing hollow tubular bearing members having openings for the wires located adjacent the ends thereof facing the interposed spool carrier, in combination with concave guide pots having oppositely disposed open projecting ends and being fixed at their bases to the facing ends of the bearing members for rotation therewith, each pot being constructed to provide an outer curved guide surface which is approximately defined by the wire path as the generatrix rotated symmetrically around the machine axis between two successive bearing members, the wire openings in each bearing member being situated outside the curved guide surface of its associated guide pot.

A retaining ring is preferably arranged around the projecting open end of each guide pot, for example a ring having an inner arcuate or bowed wire-contacting surface as formed by a curved generatrix and mounted by bridging support members concentrically on the outer rim or open end of the pot. The inner wire-contacting surface of the retaining ring is curved to bow in the direction opposite to the unobstructed or normal curved path of the transported wire.

Figure 2:
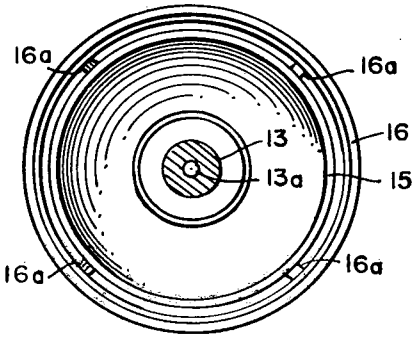

A preferred embodiment of the invention is described by way of example as follows in conjunction with the drawing in which:

FIG. 1 is a side elevational view, partly schematic and partly in cross-section of the improved combination according to the invention in an otherwise conventional high-speed twisting machine, and FIG. 2 is a view of the guide pot of the invention taken on line 2—2 of FIG 1.

The tubular bearing members 1 are rotatably mounted in the bearing assemblies or blocks 2 and 3 by means of ball bearings 4. As can be seen in the bearing assembly 2 shown in section in FIG. 1, a V-belt pulley 5 is fastened onto the outer cylindrical surface of the bearing tube or roller 1. The bearing tube 1 is driven through the V-belt pulley 5 by the V-belt 6 which in turn is run by pulley 7 and the drive shaft 9 common to all the bearing tubes as so-called rotor units 8 of the high-speed twisting machine. The drive shaft 9 is mounted for rotation in the bearing assembly or block 2 by means of the ball bearings 10. The bearing block 3 and all other bearing blocks belonging to the same twisting machine contain the same structural elements 4 to 7 and 9 and 10, because all the rotor units 8 must be driven at the same rotational speed. Instead of using a V-belt drive, it is also possible to use a gear belt drive or any other conventional low-slip transmission system.

The bearing tube 1 in every case includes at least one inlet bore 11 and at least two outlet bores 12 for guiding or transporting the wires to be twisted. These bores 11 and 12 extend obliquely to the machine axis and are aligned diagonally across the tube, i.e. at diametrically opposite points near the two ends of the tube 1, for passage of a wire from a preceding rotary unit. The first bearing tube in the series of axially aligned tubes requires only an axial inlet 13*a* to receive the first wire from a conventional supply spool (not shown) and each succeeding tube 1 is provided with this axial inlet bore 13*a* to receive the wire taken off from the preceding take-off spool as schematically shown in FIG. 1.

Journals or stub shafts 13 are rigidly connected to the ends of the bearing tubes 1, and the guide pots 15 are tightly connected to the bearings 1 between the flanges 14 of the journals 13 and the ends of the bearing. Threaded journals 13 and flanges 14 may be used to achieve a tight connection or the pots 15 may even be permanently joined to the bearing tube 1. In order to adapt the twisting machine to different types of wires, filaments or the like, it is preferable to removably mount the pots 15.

On the outer periphery of the open end or rim of the guide pot 15, a ring 16 is arranged concentrically to the pot 15 and attached thereto by means of spacer or bridging members 16*a* as more fully illustrated in FIG. 2. The spacer members are separated from one another in the peripheral direction by such intervals that they are contacted by the wires which tend to deflect outwardly in this peripheral direction. The spacer members 16*a* can thus be in the form of three or four relatively narrow supports or bridges distributed uniformly over the periphery of the guide pot 15. The width of the ring 16, i.e. in the direction of the machine axis, is such as to produce a very low contact pressure between the wire and the ring 16. The inner wire-contacting surface 16*b* of the ring is curved or bowed in the axial direction. The width and curvature of the ring are preferably adapted to one another in such a way that the wire, as it runs onto and off from the ring 16, will follow closely along the inner surface of the ring 16 without being sharply deflected from it.

At their projecting ends 17, two opposing journals 13 together support a spool carrier 18 in such a way that this carrier is able to oscillate or rock freely about the common axis of rotation of the journals 13. The spool carrier 18 in turn carries a wire take-off spool 20 freely rotatable about a spindle 19. This rocking or oscillating cradle support of the carrier 18 for the take-off spool 20 is quite conventional, the carrier usually being constructed to provide a low center of gravity below the machine axis so that the rotor units 8 can be operated at high speed while the cradled take-off spools remain in about the same position as wire is drawn off into the machine.

The wire 21 coming from each take-off spool is guided through the axial bore 13*a* in the left-hand journal 13 of each rotor unit 8, as shown in FIG. 1, into the bearing tube 1 which it leaves again through one of the wire-guide bores 12 after deflection around the guide pin 22 which is fixedly mounted in the bearing tube 1. A continuously transported wire 23 travels through between the guide 15 and the ring 16 (left-hand side of the rotor unit 8) before entering the bearing 1 through an obliquely transverse wire inlet bore 11. The wire then travels through the bearing and leaves it again through a wire outlet bore 12. After the two wires 21 and 23 have traveled around the guide pot 15 arranged between the bearing blocks 2 and 3 and the spool 20 with its carrier 18, they travel through the next bearing tube 1 rotatably mounted in the bearing block 3 in the same way as the wire 23 traveled through the bearing tube 1 in the bearing block 2. The wire 24 coming from the spool 20 travels through the axial bore in the associated journal 13 into the bearing tube 1 mounted in the bearing block 3 in exactly the same way as the wire 21 entered the bearing 1 in the bearing block 2.

The dash-dotted lines of each wire 21 and 23 indicate the path followed by the wires when the machine is stationary or when it is turning at a relatively low rotational speed. The gentle deflection of the wire along the guide pot 15 prevents damage to the wire and also prevents the buildup of excessive wire tension. The dashed lines of wires 21 and 22 indicate the path followed by the wire during the twisting operation at very low wire tension and high rotational speed. In this case, the intimate contact between the wire and the ring 16 provides for a slight increase in wire tension which results in disappearance or substantial reduction of the balloon. In this way, the path followed by the wire approaches more closely to its ideal form, i.e. in which the wire comes lightly into contact with the ring 16 and/or the outer curved guide surface of pot 15. Preferably, the wire is transported to fly freely, i.e. so that it runs for the most part in a free balloon path between pot 15 and the retention ring 16. At most, in this preferred wire path, there should be only a light contact of the wire with the curved inner surface of the retention ring 16.

The adjustment of wire tension by the wire-tension adjustment means associated with the wire (see for example DT-OS 1,808,120, pages 7 and 10) cannot be impaired because the more pronounced fluctuations in the tension of the balloon, where they exceed the adjustment range, are arrested by the ring 16 and the pot 15.

The wires are drawn off from the machine and twisted or stranded at the outlet end of the machine in a conventional manner as disclosed in the prior art discussed above or in such references as U.S. Pat. Nos. 1,870,290 or 3,636,692, the latter being issued to one of the present inventors and incorporated herein by reference as fully as if set forth in its entirety in order to illustrate a typical overall operation of a high-speed wire-stranding machine including an initial feed spool and a final disc plate or stranding point where the accumulated wires are stranded together into the final product.

For stranding wires at high speed, the twisting machine is generally operated in a conventional manner after first threading the wires through the individual rotor units 8 which require the special combination of the tubular bearing member and guide pot according to the invention. The speed of the wires and their tension can be adjusted in the usual manner, and the final stranding step can be accomplished by known means with or without a straight core wire. The improvement of this invention is thus widely adaptable to all wire stranding variations or techniques, especially where the pots 15 are replaceable.

The most important advantage of this invention is the fact that the wires are deflected in a very gentle arc and are in relatively light running contact with the outer surface of the guide pot over a substantial distance. In this way, it is possible to minimize the deformation forces acting on the wires and to correspondingly reduce the tractive or pulling force required to transport or take off the wires. As a result, the contact pressure between the wires and the guide elements is also reduced with advantage, so that the guides need only be made of normal steel and not of the highly wear-resistant materials normally required for this purpose, e.g. such as steel alloys, metal carbides or ceramic inserts. Another advantage resides in the fact that the wire openings through the bearing tube are not concealed by the guide pot. Accordingly, threading of the wire through the bearing tube is not impaired by the attached pot either in terms of visibility or in terms of accessibility.

It has been found in practice that a high-speed twisting machine of this kind can be operated with very low levels of wire tension. Although these low levels of wire tension are highly desirable, they also result in considerable "ballooning" of the unguided or free wire in passing around the spools and carriers. Any increase in the ballooning effect is accompanied by an increase in the tractive or pulling force. However, since the high-speed twisting machine is ordinarily provided with a conventional wire-tension adjustment, this adjustment reacts to any increase in tractive force by delivering more wire. This in turn leads to a further increase in the size of the balloon, with the result that the tension adjustment is in danger of becoming ineffectual. This danger can only be obviated by maintaining a very high minimum wire tension.

The preferred embodiment of the invention using the retaining ring 16 is especially useful for avoiding the disadvantages referred to above as caused by the ballooning effect. The advantage of this retaining or outer guide ring 16 is that the wire tension in the ballooning range acts directly on the adjustment only in a certain optimum range. The ideal wire tension can be set at a very low level, because as the balloon increases in size the wire comes into increasing contact with the inner curved surface of the ring, thereby producing a self-regulating effect which keeps the wire tension in the adjustment range for which the particular adjustments are designed. On the other hand, the wires are still able to travel without contacting or in only limited contact with the outer guide surface of the guide pot 15 and the inner surface of the ring 16. This means that one can still work under an optimum, i.e. low, tractive force. The free flight of the wires is not impeded nor is wire tension increased by the peripheral limitation or completely restricted movement of the wire guides otherwise normally present in previous devices, for example as in DT-OS 1,735,012.

Minor changes in construction and arrangement of the bearing tube and guide pot can be made without departing from the essential features of this combination and without relinquishing the advantages of the invention. At the same time, substantial changes can be made in non-critical parts of the twisting machine, e.g. with respect to feed or take-off spools, stranding techniques and the like while still retaining all of the advantages of the invention.

The invention is hereby claimed as follows:

1. A process for twist stranding a plurality of wires in a high-speed stranding machine which comprises:

withdrawing said wires from a corresponding plurality of feed spools arranged at spaced intervals on a common stranding axis;

guiding the wire from each of said feed spools first to a deflection point located on said common stranding axis in front of each spool position;

directing each said wire in the same take-off direction from said deflection point in a balloon pattern at the same rotational speed around the adjacent spool and each succeeding spool in the take-off direction;

further guiding each wire as it is directed through its rotating balloon pattern by means of a first curved guide surface extending a short distance between said deflection point and the adjacent spool and also by means of a second curved guide surface being located at an axially spaced interval opposite said first curved guide surface and extending a short distance between the preceding spool and the next adjacent point where the balloon crosses the stranding axis, each of said curved guide surfaces conforming approximately to the free path generated by the rotating balloon around each spool during the twist stranding process, thereby gently deflecting the wire from within each balloon as tension on the wire is increased;

further guiding each wire by an outer retaining ring surface located at a radially outwardly spaced position around each of said first and second curved guide surfaces at their outermost opposed edges conforming to the freely rotating balloon, thereby contacting and lightly deflecting the wire at a point along the outside of each balloon as the tension on the wire is decreased; and conducting said wires in said balloon pattern free of peripheral limitation or restricted movement aside from said first and second curved guide surfaces and said retaining ring surfaces.

2. A process as claimed in claim 1 wherein the wires remain in light running contact only with the outer retaining ring surface during twist stranding at high rotational speeds.

* * * * *